United States Patent [19]

Strong

[11] 4,255,958

[45] Mar. 17, 1981

[54] METHOD AND APPARATUS FOR PRECISION LOCATING OF A WORKPIECE IN A PRESS BRAKE

[76] Inventor: Thomas J. Strong, 2219 W. Vineyard, Tempe, Ariz. 85282

[21] Appl. No.: 62,702

[22] Filed: Aug. 1, 1979

[51] Int. Cl.[3] ..... B21D 7/06; B21D 11/22

[52] U.S. Cl. ..... 72/389; 72/413; 72/461

[58] Field of Search ..... 72/389, 386, 465, 396, 72/470, 475, 478, 413, 461; 403/263

[56] References Cited

U.S. PATENT DOCUMENTS

| | | | |
|---|---|---|---|
| Re. 23,939 | 2/1955 | Keller | 72/396 |
| 766,080 | 7/1904 | Warner | 403/263 |
| 2,229,917 | 1/1941 | Cunningham | 83/467 |
| 3,474,657 | 10/1969 | Spiegel | 72/478 |
| 3,757,561 | 9/1973 | Rupert | 72/461 |

FOREIGN PATENT DOCUMENTS

| | | | |
|---|---|---|---|
| 199032 | 8/1958 | Austria | 72/386 |

*Primary Examiner*—Lowell A. Larson
*Assistant Examiner*—Gene P. Crosby
*Attorney, Agent, or Firm*—Herbert E. Haynes, Jr.

[57] ABSTRACT

A plurality of die segments are assembled to form a male die for use in a press brake, and the male die assembly is provided with at least a pair of workpiece locating die segments which, at the start of the workpiece forming operation, move into registered engagement with blind recesses formed along an intended forming centerline of the workpiece for precision positioning thereof prior to completion of the workpiece forming operation.

12 Claims, 8 Drawing Figures

METHOD AND APPARATUS FOR PRECISION LOCATING OF A WORKPIECE IN A PRESS BRAKE

BACKGROUND OF THE INVENTION

1. Field of the Invention

This invention relates to a press brake and more particularly to a press brake male die assembly for precision positioning of a workpiece in the press brake.

2. Description of the Prior Art

As is well known in the art, press brakes utilize a fixedly mounted female die and a reciprocally movable male die for folding, bending or otherwise forming work pieces, such as sheet metal, in two dimensions only. For example, such machines are often used to form elongated uniform channels, gutters, and other configurations which require that the workpiece be bent at various places thereon. Forming operations of this type oftentimes require that several individual sequential steps be performed on a single sheet of material. For example, complex cross sectional products may be developed by employing several different die sets, or by repeated use of a single die set, to form the product section-by-section, such as a sheet of uniformly corrugated configuration.

In the way of a simple example of such a multistep workpiece forming operation, consider the formation of a four-sided pan-shaped box from a flat sheet of material. First, the flat sheet is suitably cut and notched such as in a punch press, at each of its corners and then each side is individually and sequentially bent along a bend or forming centerline to provide the four upstanding sidewalls of the box.

In using a press brake for operations of the above described type, it is extremely important that the workpiece be exactly positioned between the male and female die set. When several individual and sequential operations are accomplished on a single workpiece, a plurality of related positions must be established and accurately followed if the desired configuration of the finished product is to be achieved.

Press brakes usually incorporate gages or guide members, sometimes referred to as fences, for receivably engaging the edge of a workpiece to limit the extent to which the workpiece may be inserted between the die set. The use of such gages or fences is reasonably accurate, however, if a slight positioning error is made on one of the first in a series of sequential operations, the error will be repeated and enlarged as the subsequent position related operations are accomplished.

Therefore, a new and improved method and apparatus for precision positioning of a workpiece in a press brake is needed to overcome some of the shortcomings and drawbacks of the prior art.

SUMMARY OF THE INVENTION

In accordance with the present invention, a new and useful method and apparatus for precision positioning of a workpiece in a press brake is disclosed.

The preferred embodiment of the apparatus of the present invention comprises a male die assembly which includes a plurality of individual die segments of various lengths which are assembled in various combinations to achieve the desired length of the assembled male die. When making up a male die, by combining die segments of various lengths, at least two special locator die segments are included therein at predetermined locations along the length of the assembled male die. Each of the special locator die segments includes a pilot pin extending from a retractable slide member means which is located so as to protrude from the leading edge of the workpiece engaging surface of the male die assembly.

In a second embodiment of the present invention, an elongated male die body has a spaced pair of bores formed therein with a pilot pin extending from a slide member means mounted in each of the bores.

A workpiece to be formed in a press brake, either by the above described male die assembly or by the elongated male die, is provided with at least a pair of preformed prick marks, or blind recesses, which are made either by machine or by hand, so as to lie along each of the centerlines of the bends to be made in the press brake. These blind recesses, formed so as to lie along a single centerline, are in spaced relationship with respect to each other and that spacing is identical to the spacing between the pilot pins extending from the locator die segments of the assembled male die of the present invention or from the single elongated male die. When a workpiece, prepared as described above, is placed in the press brake, the blind recesses lying along the bend centerline are located, either by means of preset gages or by hand, so as to be as close as possible to the desired position between the male and female dies. The male die assembly or the single male die of the present invention is then lowered to bring the pilot pins into engagement with the blind recesses formed in the workpiece. The pilot pins and the blind recesses are configured so that if slight misalignment therebetween exists, the downwardly moving pilot pins will move the workpiece into the exact desired position.

Accordingly, it is an object of the present invention to provide a new and useful male die assembly for use in a press brake.

Another object of the present invention is to provide a new and useful method and apparatus for precision positioning of a workpiece in a press brake.

Another object of the present invention is to provide a new and useful male die assembly for a press brake with the male die assembly including a plurality of individual male die segments of various lengths which are assemblable in various combinations to achieve a desired length of the die assembly.

Another object of the present invention is to provide a new and useful male die assembly of the above described character which includes at least two locator die segments positioned in spaced relationship along the length thereof for precision positioning of an especially prepared workpiece in the press brake.

Another object of the present invention is to provide a new useful male die assembly of the above described type in which each of the two locator die segments includes a pilot pin extending from a slide member means which retractably protrudes from the leading edge of the workpiece engaging surface of the male die assembly.

Another object of the present invention is to provide a new and useful male die assembly of the above described character in which the protruding pilot pins are configured to registeringly engage special blind recesses formed in the workpiece and reposition the workpiece if necessary to correct slight positioning errors thereof.

The foregoing and other objects of the present invention as well as the invention itself, may be more fully understood from the following description when read in conjunction with the accompanying drawings.

DESCRIPTION OF THE PREFERRED EMBODIMENTS

Figure 1:
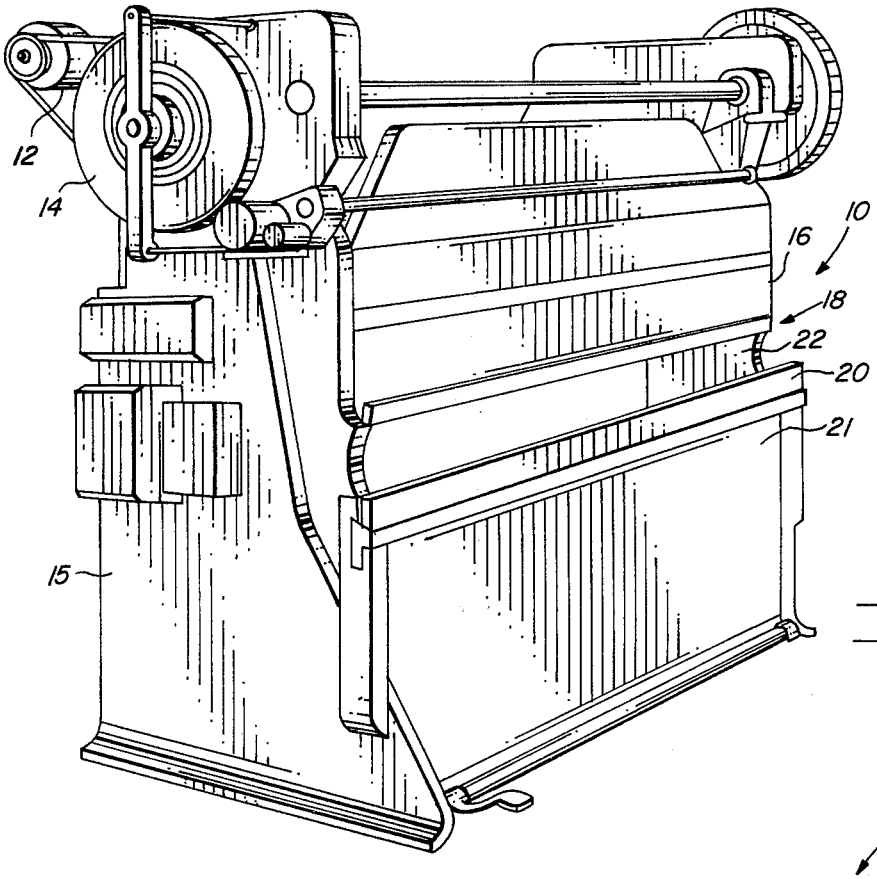
FIG. 1 is a perspective view of a typical type of press brake machine having the male die assembly of the present invention mounted therein.

Referring more particularly to the drawings, FIG. 1 illustrates a press brake machine of the type well known in the art and of a type suitable for use in the practice of the present invention with the press brake machine being indicated generally by the reference numeral 10.

The press brake machine 10 includes the usual electric motor 12 for driving a rotary structure 14 which is suitably carried in the machine's frame 15. An assembly (not shown) is also carried in the frame 15 for converting the rotary motion of the rotary structure 14 into reciprocal motion for driving the upper press member 16. As will hereinafter be described, the upper press member 16 carries the male die assembly 18 of the present invention, which is vertically spaced above and in aligned relationship with a suitable female die 20 that is fixedly mounted on the stationary lower press member 21. The male die assembly 18 is reciprocally movable with the upper press member 16 toward and away from the female die 20 with the space therebetween defining a workpiece receiving throat 22.

Figure 2:
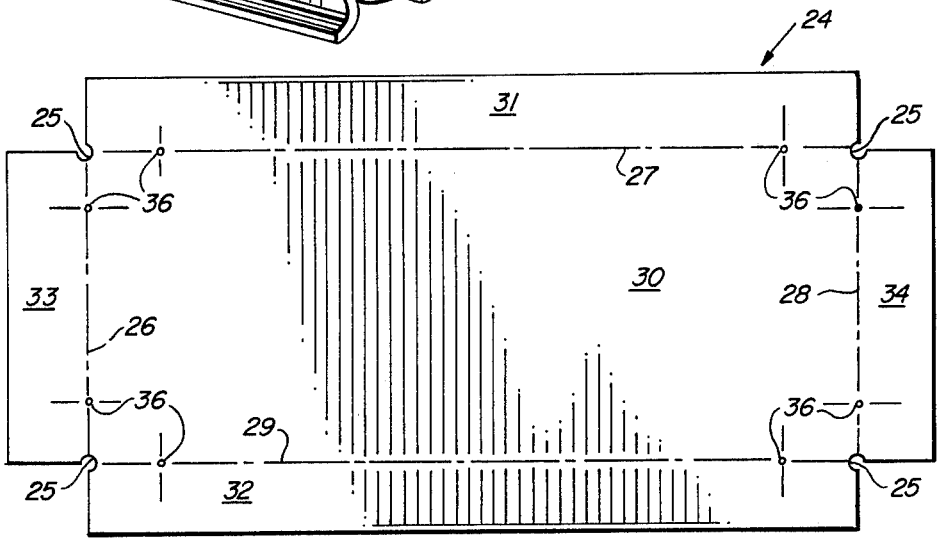
FIG. 2 is a plan view of a flat workpiece illustrating the special preparatory work accomplished thereon prior to being formed by the press brake having the male die assembly of the present invention mounted thereon.

As is well known in the art, a workpiece, such as that indicated generally by the reference numeral 24 in FIG. 2, and which is a flat sheet of metal or other suitable material, is inserted into the throat of the press brake machine 10 to a depth determined by an adjustable gage or fence structure (not shown) which is located in a setback position within the throat 22. When the machine 10 is actuated, the press member 16, and the male die assembly 18, will move toward the fixed female die 20 in a motion which is sometimes referred to as a downstroke. Such a downstroke moves the male die assembly 18 into engagement with the workpiece 24 that is usually placed so as to be restingly positioned on the female die 20, and will bend or otherwise deform the workpiece into conformity with the configuration determined by the male and female dies. The forming, or downstroke, is followed by an upstroke which separates the dies to enable removal of the workpiece. Upon completion of such a cycle of operation, the workpiece may be completely removed from the machine 10, or it may be reinserted in another position, as determined by the desired end configuration of the workpiece, so that other operating cycles of the machine may be employed to shape other sections of the workpiece.

As hereinbefore mentioned, workpieces suitable for bending or other deformation in the press brake machine 10 are flat sheets of metal or other flat stock material, and the workpieces are prepared in accordance with accepted practices and are further especially prepared in accordance with the principles of the present invention.

The preparation of the workpiece includes, in addition to the special preparations which will hereinafter be described in detail, the customary cutting operations to properly size the workpiece, stamping operations to form any necessary holes or notches therethrough, and any other operations required by the desired end product configuration, and which are best accomplished while the workpiece is still in the flat state.

Reference is now made to FIG. 2 wherein preparation of the specific workpiece 24 will now be explained in detail. The flat stock workpiece 24 is shown as having been cut to size, and prepared for making a rectangular pan-shaped structure and each of the corners have been notched and relieved as at 25 to facilitate subsequent stock bending operations. The workpiece 24 is suitably marked with lines 26, 27, 28 and 29 which are the centerlines for the intended stock bending operations. Those bend or forming centerlines divide the workpiece into a center section 30 which will ultimately form the bottom of the pan structure, an opposed pair of elongated side sections 31 and 32 which will ultimately form the longitudinal upstanding sidewalls of the pan structure, and an opposed pair of end sections 33 and 34 which will ultimately form the upstanding end walls of the pan structure. The above described preparations are representative of the customary operations performed on a flat workpiece prior to its being bent into the final configuration in a press brake. In accordance with the principles of the present invention, an additional special operation is performed on the workpiece 24, and the purpose of this special operation will become apparent as this description progresses.

Each of the centerlines 26, 27, 28 and 29 are provided with at least two blind recesses 36, or prick marks, laying thereon which are spaced apart at an exact predetermined distance. Locating and formation of the blind recesses 36, may be accomplished in any convenient and suitable manner which, an addition to hand operations, may include the use of a manual or numerical control fabricator, a vertical mill, or permanent tooling such as a die set, progressive die or other fixtures.

Figure 3:
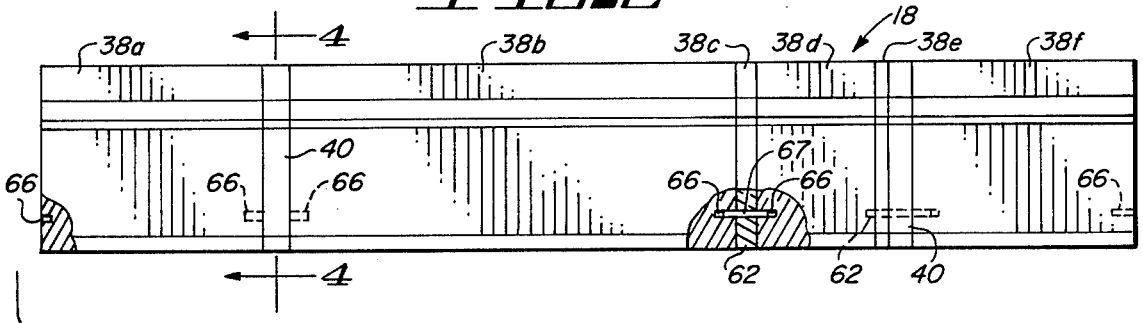
FIG. 3 is a front elevational view of the male die assembly of the present invention and illustrating the various features thereof.

The male die assembly 18 of the present invention, as seen best in FIG. 3, is made up of a plurality of male die segments 38*a*, 38*b*, 38*c*, 38*d*, 38*e* and 38*f* of various lengths, and as will hereinafter be described in detail also includes at least a pair of spaced apart special locator male die segments 40. The length dimensions of the die segments 38*a*–38*f*, and the special locator die segments 40, are such that the segments are multiples of each other. For example, consider the die segment 38*b* as having a length dimension of X, the die segments 38*a* and 38*f* will then each have a length dimension of ½ X, segment 38*d* will have a length dimension of ¼ X, segment 38*c* will then have a length dimension of 1/16 X and segment 38*e* will have a length dimension of 1/32 X. The special locator die segments of this example are provided with length dimensions of 1/16 X. By employing a plurality of die segments 38*a*–38*f* in various combinations, the male die assembly 18 can be easily made up in any desired multiple length, and the special locator dies 40 may be suitably located to achieve any desired spacing therebetween.

Figure 4:
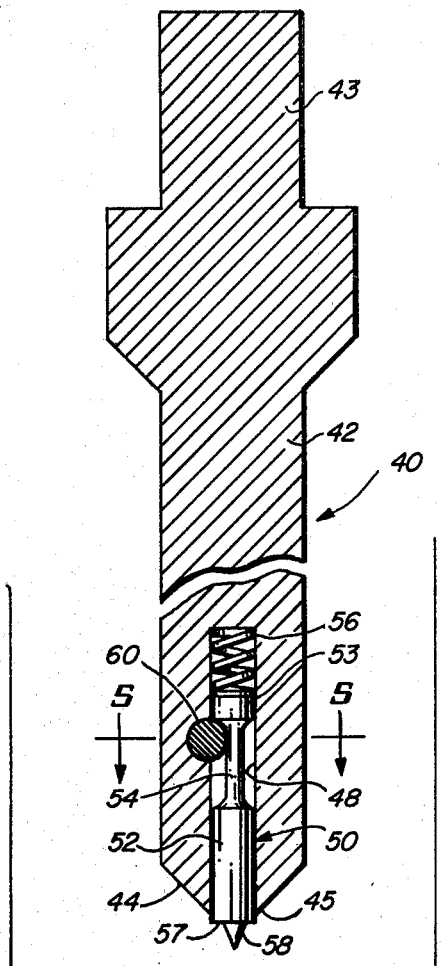
FIG. 4 is an enlarged sectional view taken on the line 4—4 of FIG. 3.
Figure 5:
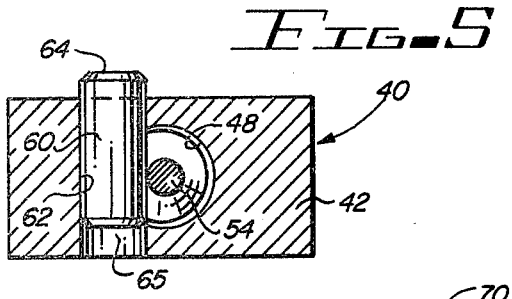
FIG. 5 is a sectional view taken on the line 5—5 of FIG. 4.

Reference is now made to FIGS. 4 and 5 wherein the preferred embodiment of a typical one of the special locator die segments 40 is shown. The locator die segment 40 is provided with a vertically elongated die body 42 of conventional configuration having the usual shank 43 located at its upper end by which the die is mounted in the press brake 10, and having the usual workpiece engaging surface 44 with a leading edge 45. The die body 42 is provided with a blind bore 48 extending vertically upwardly from the leading edge 45 thereof, and a slide member means 50 is axially slidably mounted in the bore. The slide member 50 is formed with a lower cylindrical land 52 and a spaced upper cylindrical land 53 which are integrally interconnected by a reduced diameter stem 54. The slide member 50 is biased toward the open lower end of the bore 48 by a biasing means in the form of a compression spring 56. The compression spring 56 is seated in the closed upper end of the bore 48 and exerts its biasing force on the top surface of the sliding member's upper land 53. As will hereinafter be described, the bottom surface 57 of the lower land 52 forms a shoulder and has a pilot pin 58 which is preferably of inverted conical configuration extending axially therefrom. The slide member 50 is retained in the bore 48 of the die body 42 by a retainer pin 60 which is carried in an off-center transverse passage 62 that is drilled or otherwise formed through the die body. The off-center positioning and vertical disposition of the transverse passage 62 is such that the retainer pin 60 extends through the space between the lower and upper lands 52 and 53 of the slide member 50, and is laterally offset from the reduced diameter stem 54. Thus, the downward sliding movement of the slide member 50 is limited by engagement of the bottom surface of the upper land 53, as shown in FIG. 4, and the slide member may be moved upwardly against the biasing force of the spring 56.

As seen best in FIG. 5, the retainer pin 60 is preferably positioned in the transverse passage 62 so as to provide an extending end 64 of the pin, and to leave the opposite end of the passage open as at 65. Such positioning of the retainer pin 60 allows it to be used as an alignment and interconnecting means by which the locator die segment 40 is aligned and attached to the adjacent die segments 38 on each of its opposite sides. Thus, as seen in FIG. 3, the male die segments having relatively short length dimensions, such as 38*c* and 38*e*, will have similar passages 62 drilled or otherwise formed all the way through for receiving the protruding end 64 of the retainer pin 60 when one of the locator die segments is located adjacent thereto. However, since it is more difficult and inconvenient to form such passages all the way through the male die segments having longer length dimension, such as 38*a*, 38*b*, 38*d* and 38*f*, they may be provided with blind holes 66 on each of their opposite sides for achieving the same purpose. It will be noted that the same alignment and interconnecting technique may be used between adjacent male die segments, such as 38*b*, 38*c* and 38*d*, by simply inserting a demountable pin 67 in their aligned passage 62 and blind holes 66 as shown in FIG. 3.

Figure 6:
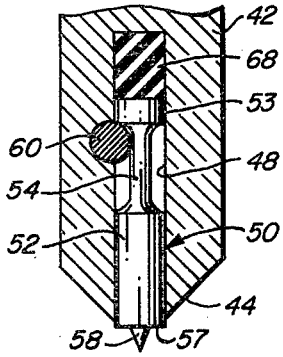
FIG. 6 is a fragmentary sectional view similar to FIG. 4 and illustrating a modification of the male die assembly of the present invention.

As seen in FIG. 6, the biasing force employed to yieldably urge the slide member means 50 toward the open end of the bore 48 of the die body 42, may be in the form of a block of resilient elastomeric material 68, such as rubber.

Figure 7:
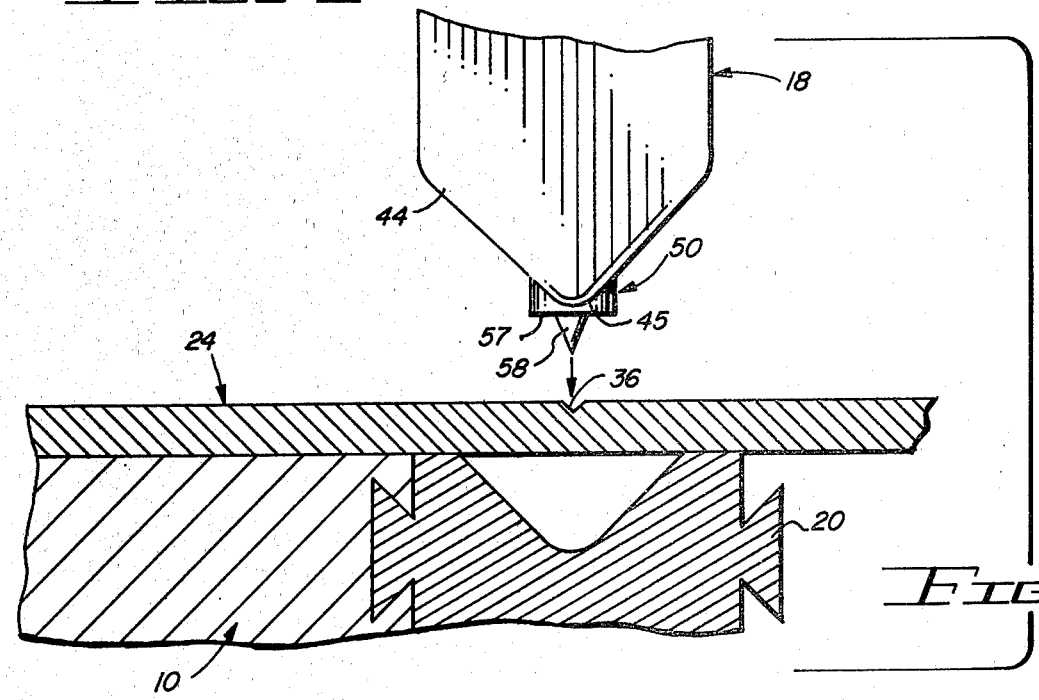
FIG. 7 is a sectional view taken transversely through the male die assembly, a typical workpiece, and a typical female die to illustrate the relationships and operation thereof.

Referring now to FIG. 7 wherein the workpiece 24 is shown as being positioned in the press brake 10 so as to rest on the fixed female die 20 with the blind recess 36 being located in vertical alignment and facing upwardly toward the slide member means 50 carried in the locator die segment 40 of the male die assembly 18. When the press brake 10 is actuated to move the male die assembly in a downstroke, as hereinbefore described, the inverted conical pilot pin 58 of the slide member 50 will move into registered engagement with the recess 36. The recess 36 is configured similarly to the pilot pin 58 and thus, defines an inverted conical opening. In this manner, if slight misalignment exists between the pilot pin and the blind recess, the pilot pin will move the workpiece 24 into the exact desired position as it moves into the recess during the downstroke. When the pilot pin 48 is fully engaged in the recess 36, the bottom shoulder 57 of the slide member 50 will be in engagement with the upper planar surface of the workpiece 24.

Continued downstroke movement of the male die assembly 18 will bend the workpiece 24 along the intended bend centerline (centerline 26, 27, 28 or 29 of FIG. 2). Such bending of the workpiece will cause the upper surface of the workpiece to exert an upwardly directed force on the shoulder 57 of the slide member means 50 which will retract the pilot pin 58 from the recess 36 so that it will not interfere with the bending operation by becoming wedged in the recess 36 that will close as a result of the bending operation.

While the preferred configuration of the pilot pins 48 and the blind recesses 36 are disclosed as being conical, it will be understood that other configurations will work equally as well, such as ball shaped and the like.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles.

Figure 8:
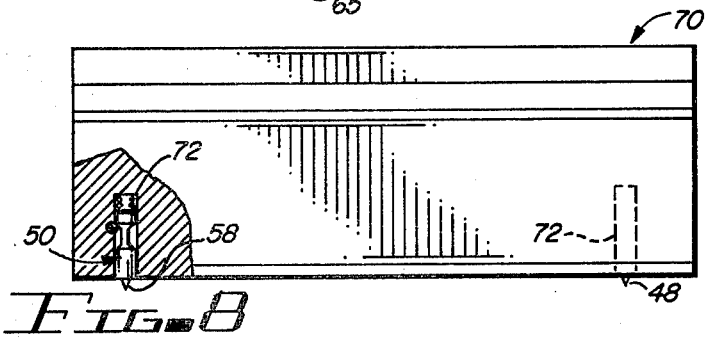
FIG. 8 is a front elevational view of a modified form of the male die of the present invention with a portion thereof broken away to illustrate the various features thereof.

For example, although the plurality of male die segments 38*a*–38*f* employed to assemble the male die assembly 18 in various multiple length dimensions is the preferred embodiment, it will be immediately obvious that a male die 70, as seen in FIG. 8, of fixed length could be provided with a spaced pair of bores 72 for containing the slide member means 50 as hereinbefore described in detail.

The appended claims are therefore intended to cover and embrace any such modifications within the limits only of the true spirit and scope of the invention.

What I claim is:

1. A male die assembly for use in a press brake machine of the type employed in forming flat stock workpieces, said male die assembly comprising:

(a) a plurality of male die segments of various lengths which are multiples of each other;

(b) means for aligningly interconnecting selected ones of said plurality of male die segments in a side-by-side relationship to assemble the male die assembly in a desired multiple length; and (c) at least a pair of locator male die segments which are assembled in spaced apart locations within the male die assembly when said plurality of male die segments are assembled in side-by-side relationship to form the male die assembly, each of said locator male die segments being for registeringly engaging the workpieces formable in the press brake machine to correct workpiece misalignment.

2. A male die assembly as claimed in claim 1 wherein said means for aligningly interconnecting said male die segments comprises:

(a) each of said male die segments having a bore formed in the opposite sides thereof with the bores of each of said male die segments in alignment with the bores of the adjacent ones of said male die segments when said male die segments are assembled in the side-by-side relationship; and (b) a pin demountably positioned in each of the aligned bores of said male die segments for aligned interconnection thereof.

3. A male die assembly as claimed in claim 1 wherein each of said locator male die segments comprises:

(a) a die body having a workpiece engaging surface on one end and having a bore formed therein so as to open onto the workpiece engaging surface;

(b) a slide member means axially slidably mounted in the bore of said die body;

(c) a pilot pin integrally formed on said slide member means so as to extend axially from the end thereof which is adjacent the open end of the bore of said die body;

(d) biasing means in the bore of said die body and engaging the other end of said slide member means for biasingly urging said slide member means toward the open end of the bore of said die body; and (e) retainer means in said die body for engagingly holding said slide member means in the bore of said die body and for limiting the axial sliding movement thereof.

4. A male die assembly as claimed in claim 3 wherein the relative sizes of said pilot pin and the end of said slide member means from which said pilot pin extends are such that this end of said slide member means forms a workpiece engaging shoulder by which said slide member means is moved against the force applied by said biasing means when the workpieces are being formed in the press brake.

5. A male die for use in a press brake machine, said male die for assuring precision positioning of a flat workpiece in the press brake machine by moving into registered engagement with at least a pair of blind recesses spacedly formed on the bend centerline of the workpiece with the blind recesses each being defined by an endless sidewall that convergingly extends into the workpiece from an open top thereof, said male die assembly comprising:

(a) a male die body having a workpiece engaging surface with at least two bores formed therein at spaced apart locations with each of the bores opening onto the workpiece engaging surface of said male die body;

(b) a slide member means in each of the bores of said male die body and axially slidable therein;

(c) a pilot pin integrally and axially extending from each of said slide member means toward the open end of their respective bores of said male die body, each of said pilot pins being defined by an endless sidewall which convergingly extends from its respective one of said slide member means and is configured to substantially match the blind recesses formed in the workpiece to registeringly engage the blind recesses formed in the workpieces that are formable in the press brake;

(d) biasing means in the bores of said male die body for yieldingly urging said slide member means toward the workpiece engaging surface of said male die body; and (e) retainer means in said male die body for engagingly holding said slide member means in their respective bores of said male die body and for limiting the axial sliding movement thereof.

6. A male die assembly for a press brake machine said male die assembly for assuring precision positioning of a flat workpiece in the press brake machine by moving into registered engagement with at least a pair of blind recesses spacedly formed on the bend centerline of the workpiece with the blind recesses each being defined by an endless sidewall that convergingly extends into the workpiece from an open top thereof, said male die assembly comprising:

(a) a plurality of male die segments arranged in side-by-side relationship to form the male die assembly; and (b) at least a pair of locator male die segments in spaced apart locations in the male die assembly formed by said plurality of male die segments, each of said locator male die segments including, I. a die body having a workpiece engaging surface on one end and having a bore formed therein so as to open onto the workpiece engaging surface, II. a slide member means axially slidable in the bore of said die body, III. a pilot pin integrally formed on said slide member means so as to extend axially from the end thereof which is adjacent the open end of the bore of said die body, said pilot pin being defined by an endless sidewall which convergingly extends from the end of said slide member means and is configured to substantially match the blind recesses formed in the workpiece to registeringly engage one of the blind recesses of the workpiece, IV. biasing means in the bore of said die body and engaging the other end of said slide member means for biasingly urging said slide member means toward the open end of the bore of said die body, and V. retainer means in said die body for engagingly holding said slide member means in the bore of said die body and for limiting the axial sliding movement thereof.

7. A male die assembly as claimed in claim 6 wherein said slide member means comprises:

(a) a first land which provides said slide member means with the end upon which said biasing means is engaged;

(b) a second land spaced from said first land, said second land provides said slide member means with the end from which said pilot pin extends; and (c) a reduced diameter stem integrally interconnecting said first and said second lands.

8. A male die assembly as claimed in claim 7 wherein said retainer means comprises:

(a) a passage formed transversely through said die body to communicate with the bore of said die body at a location where said reduced diameter stem is positioned; and (b) a pin located in said passage.

9. A male die assembly as claimed in claim 6 wherein said biasing means is a compression spring.

10. A male die assembly as claimed in claim 6 wherein said biasing means is a block of resilient elastomeric material.

11. A male die assembly as claimed in claim 6 wherein the base of said pilot pin is smaller than the area of the end of said slide member means from which it extends to provide a shoulder on said slide member means by which it is moved against the force applied by said biasing means when the workpiece is being formed in the press brake machine.

12. A method for precision positioning of a flat workpiece in a press brake comprising the steps of:

(a) preparing a workpiece by forming at least a pair of blind recesses in spaced locations on a bend centerline of the workpiece with the blind recesses each being defined by an endless sidewall which converges downwardly into the workpiece from an open top;

(b) inserting the prepared workpiece in the throat of the press brake with the bend centerline in substantial alignment between the male and female dies of the press brake with said blind recesses opening toward the male die;

(c) actuating the press brake to start the downstroke thereof to bring the male and female dies into engagement with the opposite surfaces of the workpiece, the male die having at least a pair of male die segments each of which has a yieldably biased pilot pin depending therefrom with each of said pilot pins defined by a downwardly converging endless sidewall which substantially matches the configuration of the blind recesses of said workpiece so that upon actuation of said press brake said pilot pins move into registered engagement with different ones of the blind recesses formed in the workpiece for precision positioning thereof between the male and female dies; and (d) completing actuation of the press brake to finish the downstroke thereof to foldingly form the workpiece.

* * * * *